US008052371B2

(12) United States Patent
Setozaki et al.

(10) Patent No.: US 8,052,371 B2
(45) Date of Patent: Nov. 8, 2011

(54) BAG SUPPLY APPARATUS

(75) Inventors: Masakazu Setozaki, Iwakuni (JP); Tohru Yoshikane, Iwakuni (JP)

(73) Assignee: Toyo Jidoki Co., Ltd., Tokyo (JP)

( * ) Notice: Subject to any disclaimer, the term of this patent is extended or adjusted under 35 U.S.C. 154(b) by 360 days.

(21) Appl. No.: 12/288,839

(22) Filed: Oct. 23, 2008

(65) Prior Publication Data

US 2009/0110534 A1 Apr. 30, 2009

(30) Foreign Application Priority Data

Oct. 25, 2007 (JP) ..... 2007-277191

(51) Int. Cl.
*B65H 33/00* (2006.01)
*B65H 3/54* (2006.01)
*B65G 59/06* (2006.01)
*B65B 43/14* (2006.01)

(52) U.S. Cl. ..... 414/797.5; 198/418.9; 271/182; 271/256

(58) Field of Classification Search ..... 198/418.9, 198/419.1, 644; 221/223, 251, 297, 301, 221/92–93; 271/121–123, 131, 133–135, 271/137, 148, 150–151, 35; 414/795.4, 796.1, 414/797.4, 797.5, 797.7, 797.9, 798, 798.2, 414/933

See application file for complete search history.

(56) References Cited

U.S. PATENT DOCUMENTS

| | | | | |
|---|---|---|---|---|
| 2,748,917 | A * | 6/1956 | Rawe | 198/418.9 |
| 3,223,409 | A | 12/1965 | Eissfeld | |
| 3,269,568 | A * | 8/1966 | Kemp, Jr. | 414/797.5 |
| 4,546,871 | A * | 10/1985 | Duke | 198/418.9 |
| 5,062,599 | A * | 11/1991 | Kriegel et al. | 271/35 |
| 5,738,485 | A * | 4/1998 | Bedard et al. | 414/795.4 |
| 5,820,334 | A * | 10/1998 | Darcy et al. | 414/798.1 |
| 2007/0164503 | A1 * | 7/2007 | Levin | 271/204 |

FOREIGN PATENT DOCUMENTS

| | | | |
|---|---|---|---|
| JP | H04-350040 | A | 12/1992 |
| JP | H08-337217 | A | 12/1996 |
| JP | 2004-210473 | A | 7/2004 |
| WO | WO 2005105631 | A1 * | 11/2005 |

* cited by examiner

*Primary Examiner* — Gregory Adams
(74) *Attorney, Agent, or Firm* — DLA Piper LLP (US)

(57) ABSTRACT

A bag supply apparatus for supplying bags onto a conveyer for transporting a bag bundle stacked such that an upper level bag is shifted forward, including a bag lifting device, which is provided with a pair of bag support members disposed facing one another on the left and right sides near the rear edge of a belt conveyor, and a rotation mechanism, which imparts translational motion of rotation in symmetric in a vertical plane with respect to the conveyance direction of the belt conveyor. The bag supporting portions of the bag support members contact the bag bundle from below to lift up the rear edge portion of the bag bundle and then separated from the bag bundle outwardly. While the bag supporting portions thus lifting the bag bundle, a new bag is fed into the space between the conveyance surface of the belt conveyor and the bag bundle.

7 Claims, 7 Drawing Sheets

BAG SUPPLY APPARATUS

BACKGROUND OF THE INVENTION

1. Field of the Invention

The present invention relates to a bag supply apparatus for supplying bags to a conveyer for transporting a bag bundle stacked in such a format that the upper level bag is shifted in a forward direction and more specifically to a bag supply apparatus that supplies bags to a belt conveyor of a conveyer magazine type bag supply apparatus.

2. Description of the Related Art

A bag supply apparatus of the type described above is disclosed in, for instance, Japanese Patent Application Laid-Open (Kokai) Nos. 8-337217 and 2004-210473.

In Japanese Patent Application Laid-Open (Kokai) No. 8-337217, a bag bundle (a group of bags stacked in a manner that the upper level bag is shifted in a forward direction with respect to the conveying direction of the belt conveyor of the bag supply apparatus) transported on the belt conveyor of a conveyer magazine type bag supply apparatus is transported forward; and when the bag bundle has passed a prescribed point, a push-up rods disposed below the belt conveyor is moved upward and lifts up the rear edge of the bag bundle (FIGS. 1 through 6 in this laid-open publication), or a drop-down rods disposed above the belt conveyor is lowered, engaged with both edges of the proximity of the rear edge of the bag bundle, and then raised to lift up the rear edge of the bag bundle (FIGS. 7 and 8). A replenishing bundle of stacked bags is fed from the rear into the empty space formed between the lifted-up bag bundle and the conveyance surface of the conveyer.

In Japanese Patent Application Laid-Open (Kokai) No. 2004-210473, a bag bundle (a group of bags stacked in a such format that an upper level bag is shifted in a forward direction) transported on a belt conveyor of a conveyer magazine type bag supply apparatus is transported forward; and when the bag bundle has passed a prescribed point, a push-up rods disposed below the belt conveyor is moved upward and then a support arms disposed above the belt conveyor rotates to lift up the rear edge of the bag bundle from the rear (FIGS. 1 and 2 in this laid-open publication), or a support arms disposed above the belt conveyor is lowered and rotates at the lower edge to pull the rear edge of the bag bundle from the rear and then is moved upward to lift up the rear edge of the bag bundle (FIGS. 5 and 6). A replenishing bundle of stacked bags is fed from the rear into the empty space between the lifted-up bag bundle and the conveyance surface of the conveyer.

The apparatuses disclosed in Japanese Patent Application Laid-Open (Kokai) No. 8-337217 have problems. In the bag supply apparatus that uses the push-up rods, the push-up rods interferes with the pushing-in motion of the replenishing bag bundle; while in the bag supply apparatus that uses the pull-up rods, a complicated operation is involved for the pull-up rods that make a drive mechanism thereof more complicated as well. In addition, in the bag supply apparatus of Japanese Patent Application Laid-Open (Kokai) No. 2004-210473, a 3-step operation is required to raise the rear edge of the bag bundle; and in the system that uses the push-up rods and the support arms makes the apparatus more complicated, while in the system that uses just the support arms, the actuation mechanism is more complicated. Furthermore, the apparatuses in the above-described two related arts both involve reciprocating actions; and thus, these apparatuses are not suited for high-speed operation and unavoidably generate vibrations and noise when stopped.

Furthermore, in the apparatuses of the above-described two related arts, since a stacked bag bundle (a group of bags simply layered top to bottom) is fed onto the belt conveyor of the conveyer magazine type bag supply apparatus, the upper level bag needs to be arranged by hand on the belt conveyor so that it is shifted in a forward direction. On the other hand, there is such a strong demand for a conveyer magazine type bag supply apparatus that the bag bundle is automatically formed in such a format as described above with at a predetermined pitch (interval) on the belt conveyor; as a result, such attempts have been made that one bag is fed at a time at a predetermined pitch (time interval) for that purpose. In that instance, the pulling-up or pushing-down processing capability for the bag bundle needs to be improved further compared to a case that feeds a stacked bag bundle. However, the processing capability in the apparatuses described in the above-described two related arts, Japanese Patent Application Laid-Open (Kokai) Nos. 8-337217 and 2004-210473 is inadequate.

BRIEF SUMMARY OF THE INVENTION

The present invention was made in view of these problems in the conventional techniques, and an object of the present invention is to provide a bag supply apparatus (especially a bag lifting device) that does not interfere with the feeding of replenishing bags or bundles of bags onto the belt conveyor, that is simple in operation and actuation mechanisms, that reduces occurrence of vibrations and noise, and that has high processing capability.

The above object is accomplished by a unique structure of the present invention for a bag supply apparatus that supplies bags onto a conveyer for transporting a bag bundle stacked in such a format that an upper level bag of the stacked bags is shifted forward, and in the present invention, the bag supply apparatus comprises:

- a bag lifting device for lifting the rear edge of the bag bundle which is on the conveyer, and
- a bag feeding device, provided at the rear of the conveyer, for transporting a new bag forward, when the rear edge of the bag bundle on the conveyer is lifted, and feeding the bag between the bag bundle lifted (a the rear edge thereof) above the conveyer and the conveyance surface of the conveyer; and in this bag supply apparatus, the bag lifting device is comprised of:

- a pair of bag support members disposed opposite one another on the left and right sides (either side), of the conveyer and having bag supporting portions protruding inwardly and horizontally, and
- a rotation mechanism for imparting translational motion of rotation to the bag support members, the translational motion being symmetrical on a plane that is perpendicular to a conveyance direction of the conveyer and being in mutually diverging directions in an upper half of a rotation track of the bag support members; and in this bag lifting device,

- the rotational center and the rotational radius of the bag support members are set so that the bag supporting portions of bag support members, when the bag support members are moving upward, are brought into contact from below with both side edges of the bag bundle and lift the rear edge of the bag bundle, and then the bag supporting portions are separated outwardly from both side edges of the bag bundle.

In this structure, the conveyer, for instance, intermittently operates at a set conveying distance (feed pitch); and in this case, the feed pitch is the shifting amount (pitch) between the bags that form the bag bundle on the conveyer. When the conveyer is operated intermittently, it is preferable to set a timing so that the bag lifting device lift the bag bundle and the bag feeding device feed bags when the conveyer be halted. However, in the present invention, the conveyer can be a continuously rotating type.

In the bag lifting device of the bag supply apparatus of the present invention, the time required for a single rotation which the pair of bag supporting portions make is maintained essentially constant; however, in the present invention, even if the rotation speed for a single rotation (rotational angle per unit of time) is constant, it can be so set up so that the rotation speed changes during the single rotation. In the latter instance, the rotation speed in a prescribed rotational angular range of the support elements in which the pair of support elements are supporting and lifting up the rear edge of the bag bundle on the conveyance surface of the conveyer should preferably be set slower on average than the rotation speed in the remaining rotational angular range. The angular range during which the bag supporting portions are lifting the rear edge of the bag bundle from the conveyance surface cannot be enlarged excessively; however, by way of slowing down the rotational speed in relative terms within the rotational range, it is possible to increase the time during which the bag supporting portions have the rear edge of the bag bundle lifted up from the conveyance surface and make better use of the time during which bags are fed from the bag feeding device. This setup is particularly valuable when the processing capability (number of bags supplied to a packaging machine per unit of time) of the conveyer and of the bag supply apparatus is high. More specifically, it is, in the present invention, possible to set a slower rotational speed for a part of the angular range (especially for the angular range enabling an interval during which bags can be inserted without interference between the rear edge of the bag bundle and the conveyance surface of the conveyer) or for all of the angular range, and it is further possible to temporarily stop the rotation (in other words, imparting intermittent rotation) within such an angular range.

In one example of a specific embodiment of the above-described bag lifting device, as a part of the rotation mechanism, the bag lifting device is comprised of, as a part of the rotation mechanism, a pair of rotation transmission members that make a translational motion of the same rotational radius and rotational direction as each one of the bag support members on a plane perpendicular to the conveyance direction, and the bag support members are respectively provided on the rotation transmission members.

More precisely, this bag lifting device includes a rotation transmission member ("a first rotation transmission member") that imparts translational movement that has the same rotational radius and rotational direction as that of one of the pair of (two) bag supporting portions, and another rotation transmission member ("a second rotation transmission member") that imparts translational movement that has the same rotational radius and rotational direction as that of another one of the pair of (two) bag supporting portions; and one of the bag support members is provided on the first rotation transmission member, and the other bag support member is provided on the second rotation transmission member. The first and second rotation transmission members make a symmetric rotational movements so that these rotation transmittal members rotate in opposite directions from each other. The translational motion during the rotation of each one of the rotation transmission members is transmitted to the bag supporting portion via each bag support member, and the bag supporting portion makes translational motion of rotation while maintaining a horizontal attitude.

The rotation mechanism of the bag lifting device is, as a more specific embodiment, comprised of a total of four crank mechanisms in which two of the crank mechanisms are provided for each one of the rotation transmission members, and it is further comprised of a drive power source for operating the rotating the crank mechanisms. In this structure, the crank shaft of the two crank mechanisms linked to the respective rotation transmission members are provided at the same height and with a horizontal spacing in between, and they are provided in parallel with respect to the conveyance direction of the conveyer and rotated synchronously in the same direction. The crank arms of the crank mechanisms have the same length (between the crank shaft and the crank pin) and are mutually parallel, and the rotation transmission members are linked to the respective crank pins of the crank mechanisms. As a result, a type of parallel link mechanism is constituted by the rotation transmission member and the two crank arms; and by the rotations of the crank shaft, the rotation transmission member imparts the translational motion of rotation.

Furthermore, the bag supply apparatus of the present invention can, for example, be a multiple-component bag supply apparatus in which the conveyer is provided in a plurality of numbers in parallel, the pair of bag support members are provided for each one of the conveyers, and the bag feeding device is provided at the rear of each one of the conveyers. In this structure, the rotation transmission members are provided in a pair, and a plurality of bag support members are provided on each one of the rotation transmission members and make a translational motion synchronously.

In addition, the bag feeding device of the bag supply apparatus of the present invention is comprised, for example, of a bag supporting platform, which has a conveyance surface on its upper surface, and feed pins, which protrude upward from the conveyance surface and make a contact with the rear edge of the bag on the conveyance surface of the bag supporting platform to transport the bag forward. The feed pins are raised and lowered and also moved forward and backward; and it is preferable that when raised, the feed pins protrude from the conveyance surface of the bag supporting platform and moved forward in a protruding state, and then the pins are lowered and moved backward.

The bag feeding device can be comprised of a belt conveyor; however, any conveyer system utilizing this type of feed pins can accurately set the feed-in location.

In addition, in the bag supply apparatus of the present invention, the new bag that is fed by the bag feeding device is a single bag; however, a bag bundle formed by a stack of a plurality of bags can be handled as well.

As seen from the above, in the present invention, the rear edge of a bag bundle (or a single bag) on a conveyer is supported and lifted-up at its left and right sides by the bag supporting portions that are, respectively, continuously rotated or intermittently rotated in the same direction (in other words, without making reciprocating rotations or reciprocating movements) while maintaining the horizontal attitude. Accordingly, the motion of the bag supporting portions and the actuation mechanism therefor can be simple and smooth, the occurrence of vibration and noise can be reduced; and as a result, the bag supply apparatus of the present invention has high processing capability (with shortened time period for lifting up the bag(s) per incidence). In addition, since the bag supporting portions are provided so as to protrude in a horizontally inward direction from the left and right sides of the conveyer, the bag support members do not interfere with the feeding action of the bags, which is done while the rear edge of the bag bundle on the conveyer is being lifted up, onto the conveyer from the bag feeding device.

Furthermore, since the processing capability of the bag lifting device can be enhanced, the rear edges of bundles of bags on the conveyer can be lifted just as quickly as when the bags are fed to the conveyer one after another at a rapid pitch. As a result, the bundles of bags can be stacked automatically in such a format that an upper level bag on the conveyer is shifted in a forward direction, and the pitch (shift amount of the bags) can be kept constant.

DETAILED DESCRIPTION OF THE INVENTION

A bag supply apparatus according to the present invention will be described below in detail with reference to the accompanying drawings for FIGS. 1 through 7.

Figure 1:
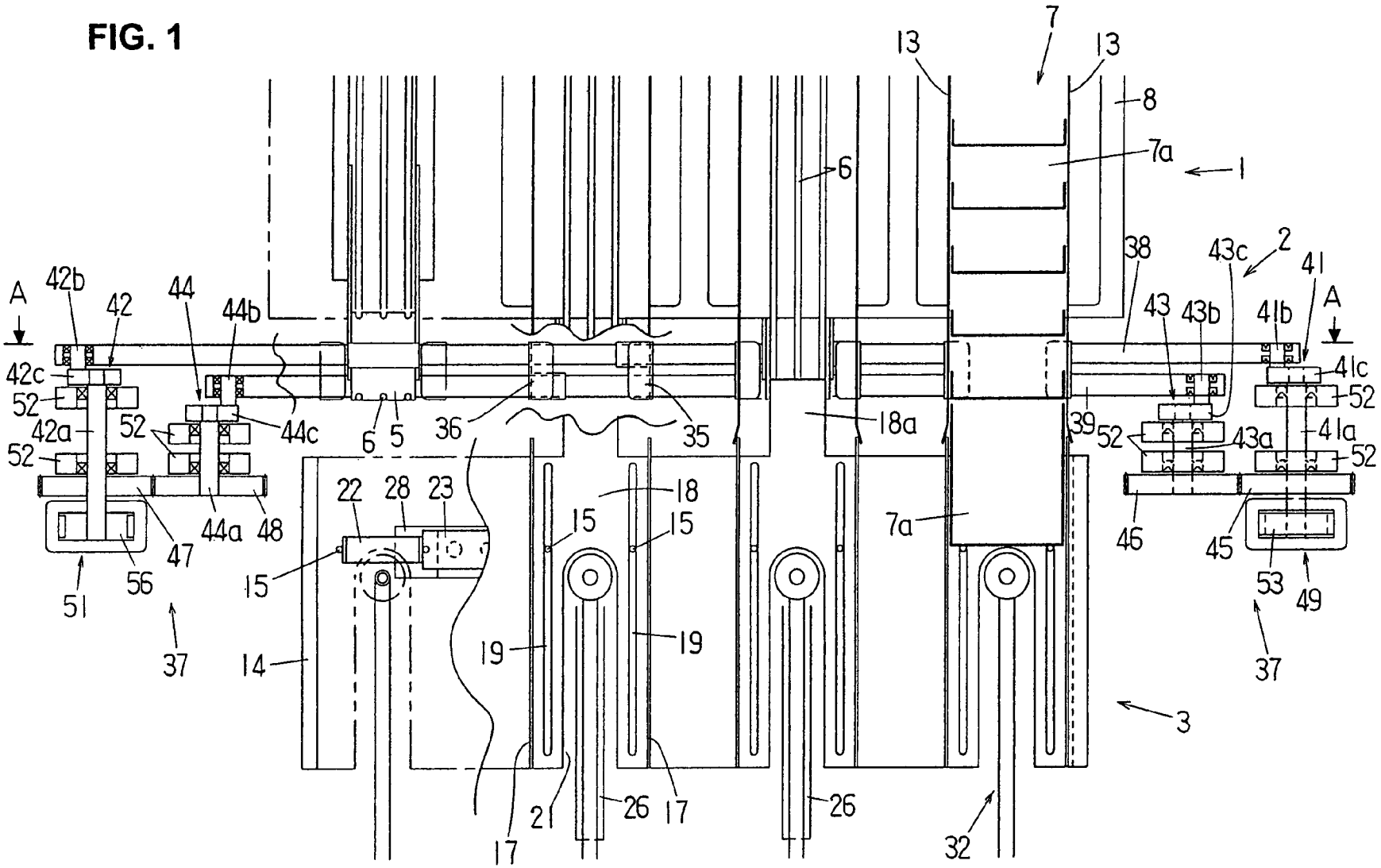
FIG. 1 is a partially cross-sectioned top view of the bag supply apparatus according to the present invention.
Figure 2:
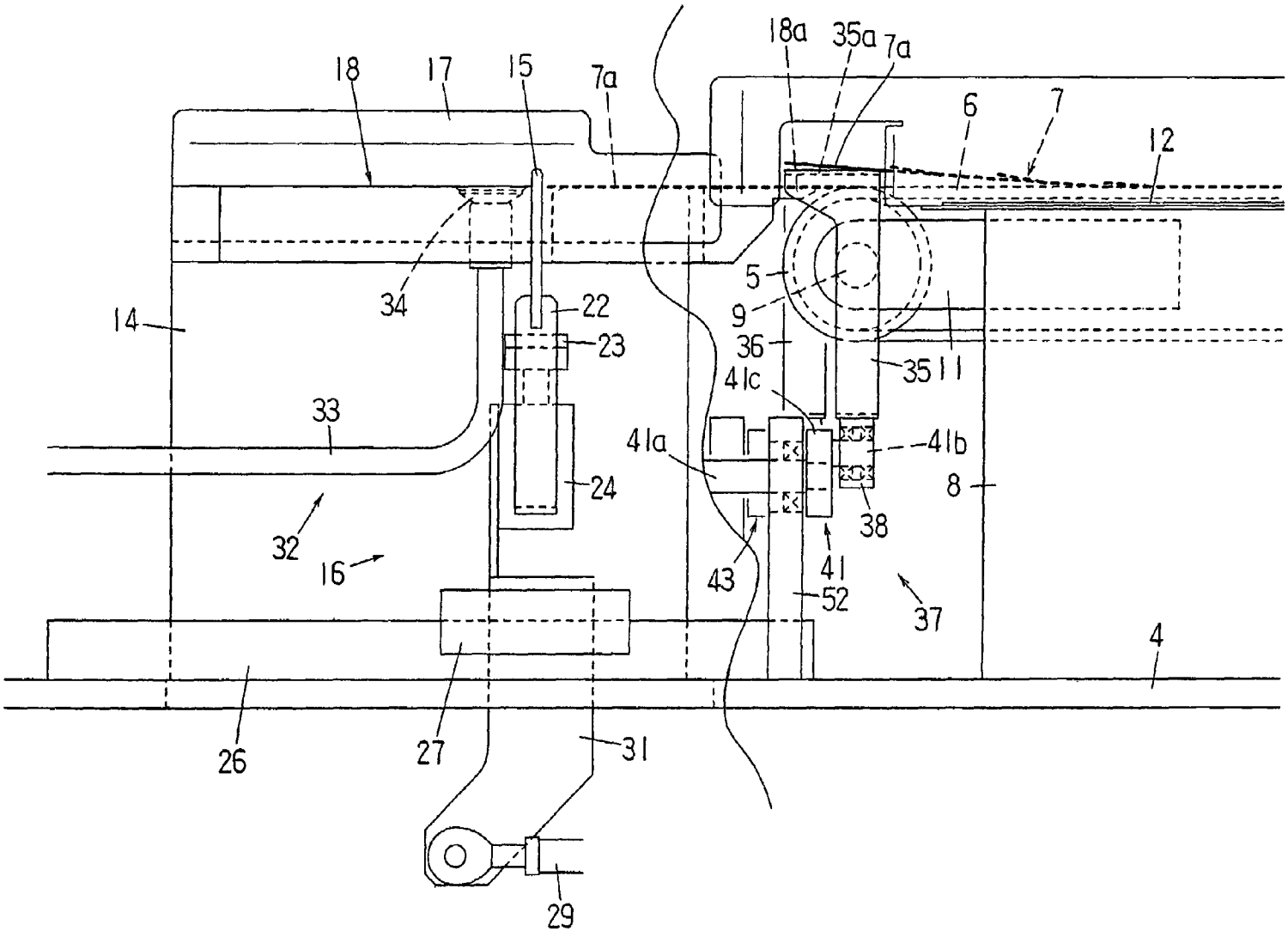
FIG. 2 is a right side view of the bag supply apparatus.
Figure 3:
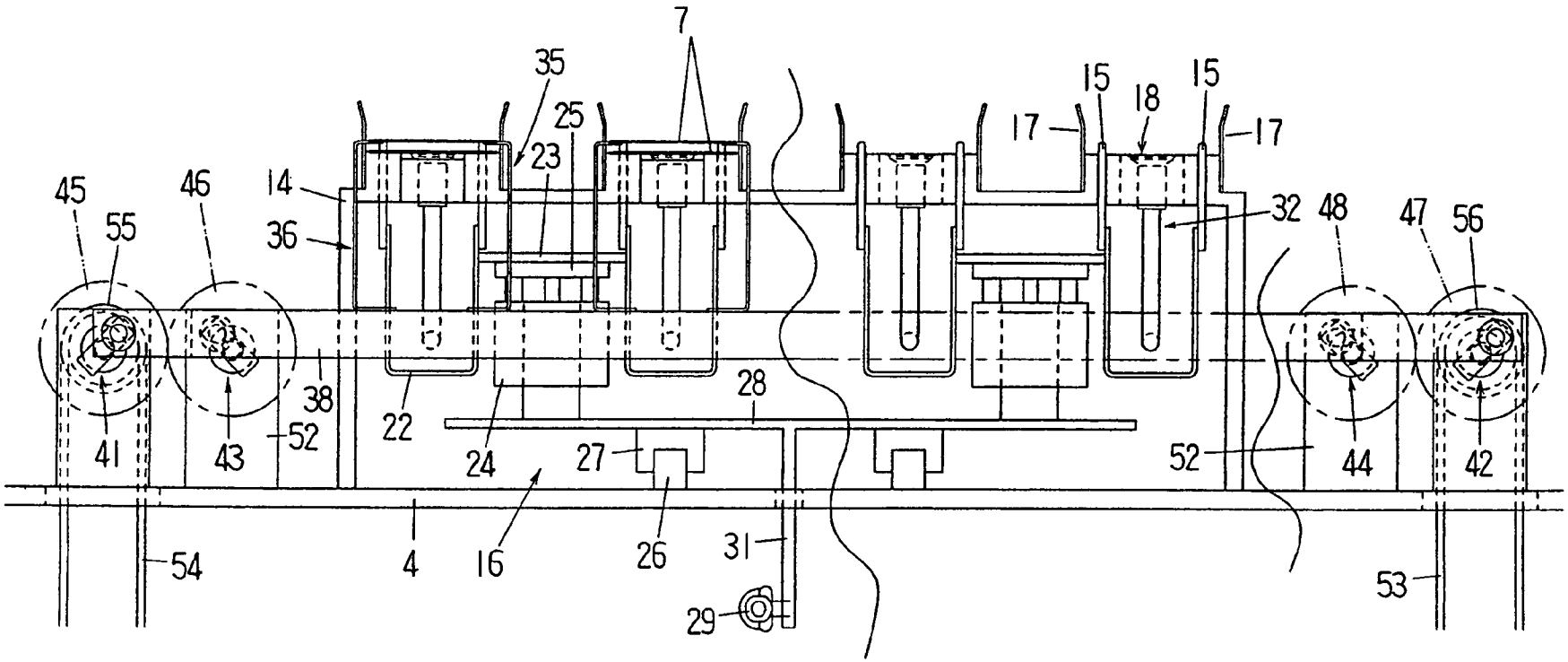
FIG. 3 is a view (partially cross-sectioned) seen in the direction of A-A in FIG. 1.

As shown in FIGS. 1 to 3, four (4) belt conveyors (also simply called "conveyer") 1, which are a part of a conveyer magazine type bag supply apparatus, are provided in parallel. A bag lifting device 2 is provided at the proximity of the rear edges of the belt conveyors 1, and a bag feeding device 3 (more specifically, four bag feeding devices) is provided on the rear side of each one of the belt conveyors 1. All of these belt conveyors, the bag lifting device and the bag feeding devices are provided on a base platform 4 of the bag supply apparatus.

Each one of the belt conveyors 1 is comprised of a front-side pulley (or a drive pulley), which are not shown in the drawings, a rear-side pulley 5 (a driven pulley), and three (3) belts (round or endless belts) installed between these two pulleys. The belt conveyor 1 makes an intermittent rotation to convey forward a bag bundle (a group of bags) 7 fed onto the conveyance surface (which is comprised of surfaces of the pulley and belt).

The bag bundle 7 is formed by a plurality of bags 7*a* stacked in such a format that an upper level bag is shifted forward (with respect to the conveying direction of the conveyers) at a constant pitch. More specifically, the conveying distance (feed pitch) in a single intermittent rotation of the belt conveyor 1 makes differential (shifted) amount (pitch) between each one of the bags 7*a* that form the bag bundle 7. In other words, if the feed pitch of the belt conveyor 1 is changed, the pitch of the bags 7*a* on the conveyance surface is changed accordingly.

The base platform 4 is provided with a frame 8 that is located under the belt conveyors 1; and on this frame 8, pulley supports 11 for supporting an pulley shaft 9 of the pulleys 5, belt support plates 12 for supporting the belts 6 from below, and guide plates 13 for guiding two side edges of the bag bundle 7 (and the bags 7*a*) are provided.

The width of the conveyance element (comprised of the pulley 5 and the belts 6) of the belt conveyor 1 is narrower than the width of the bags (or the width of the bag bundle 7), so that the bag bundle 7 (or a single bag) can be lifted or raised without mutual interference between the belt conveyor 1 and the bag lifting device 7.

Four bag feeding devices 3 are provided on the base platform 4. The bag feeding device 3 is comprised of a frame 14 provided on the base platform 4, feed pins 15, drive mechanism 16 for the feed pins 15, and guide plates 17. The guide plates 17 are secured to the frame 14, and they support both side edges of the bag 7*a*. More specifically, two feed pins 15 and two guide plates 17 are provided for each one of the four bag feeding devices 3. The drive mechanism 16 is provided to drive all four bag feeding devices 3.

The upper surface of a section on the frame 14 which is surrounded by the two guide plates 17 (a bag supporting platform 18) forms a conveyance surface of the bag feeding device 3 for the bag 7*a*. The height of this conveyance surface of each one of four bag supporting platforms 18 is set so as to be about the same height as that of the conveyance surface of the corresponding belt conveyor 1. Each bag supporting platform 18 is plate-shaped, and a pair of left and right side parallel grooves 19 are formed therein so that a pair of feed pins 15 can protrude therethrough and are moved forward (toward the belt conveyor 1) and backward (toward the bottom end with respect to FIG. 1). The bag supporting platform 18 is further formed with a central groove 21 that open to the rear edge of the center of the bag supporting platform 18 in its width direction so that a bag transfer member 32 to be described below can move up and down therethrough. Furthermore, the bag supporting platform 18 is formed with a protrusion 18*a* that extends to the pulley 5 of the belt conveyor 1 and is formed at the front side of the central portion of the bag supporting platform 18 in the width direction. The width of the protrusion 18*a* is about the same as the width of the conveyance element on the belt conveyor 1, so that mutual interference between the bag feeding device 3 (especially the bag supporting platform 18) and the bag lifting device 2 is prevented.

The drive mechanism 16 of bag feeding device 3 is comprised of a raising/lowering mechanism for raising and lowering the feed pins 15 and a moving mechanism for moving the pins 15 in forward and backward directions.

The raising/lowering mechanism of the drive mechanism 16 is, as best seen from FIG. 3, constituted by (four) U-shaped frames 22 to which each pair of feed pins 15 are attached, two frame supporting plates 23 to each of which two frames 22 are provided on the left and right sides, and air cylinders 24 (total of two units). Each frame supporting plate 23 is attached to a piston rod plate 25 that is attached to the tip ends of the piston rods of each of the air cylinders 24, so that the actions of the air cylinders 24 raise and lower the feed pins 15. When the air cylinders 24 are raised, the feed pins 15 protrude above the conveyance surface of the bag supporting platform 18; and when lowered, the feed pins 15 are lowered (sink) below the conveyance surface.

The moving mechanism of the drive mechanism 16 is constituted by, as seen from FIG. 3, a pair of rails 26 attached to the base platform 4, slide members 27 slidably fitted on the rails 26, respectively, a slide plate 28 which is attached to the slide member 27, and a drive power source (not shown in the drawings) for moving the slide plate 28 in forward and backward directions via a connecting rod 29 and a connector arm 31.

The bag transfer member 32, which is provided in association with the bag feeding device 3, is, as best seen from FIG. 2, comprised of a hollow pivot arm 33, which communicates with a vacuum source (not shown) via a changeover valve (not shown), and an adsorption member 34, which is attached to the tip end of the perpendicular portion of the pivot arm 33. The pivot arm 33 oscillates back and forth between the horizontal position which is shown in FIG. 2 and a vertical position which is not shown in the drawings. The bag transfer member 32, when it is in a vertical position, suction-holds the bag 7*a* using the adsorption member 34, and then it, while it is holding the bag, pivots (drops down) to the horizontal position, as shown in FIG. 2, and enters into the central groove 21 of the bag supporting platform 18 of the bag feeding device 3. As a result, the bag 7*a* suction-held by the adsorption member 34 is placed onto the bag supporting platform 18, and then the changeover valve is switched from the vacuum source side to the open-air side, thus allowing the adsorption member 34 to release the bag 7*a*. When the bag transfer member 32 comes to its horizontal position, the pivot arm 33 is in the middle portion of the U-shaped frame 22.

Each one of the bag lifting devices 2 of the bag supply apparatus is, as seen from FIG. 1, comprised of a pair of bag support members 35 and 36 and a rotation mechanism 37 that imparts translational motion of rotation to the bag support members 35 and 36.

Figure 4:
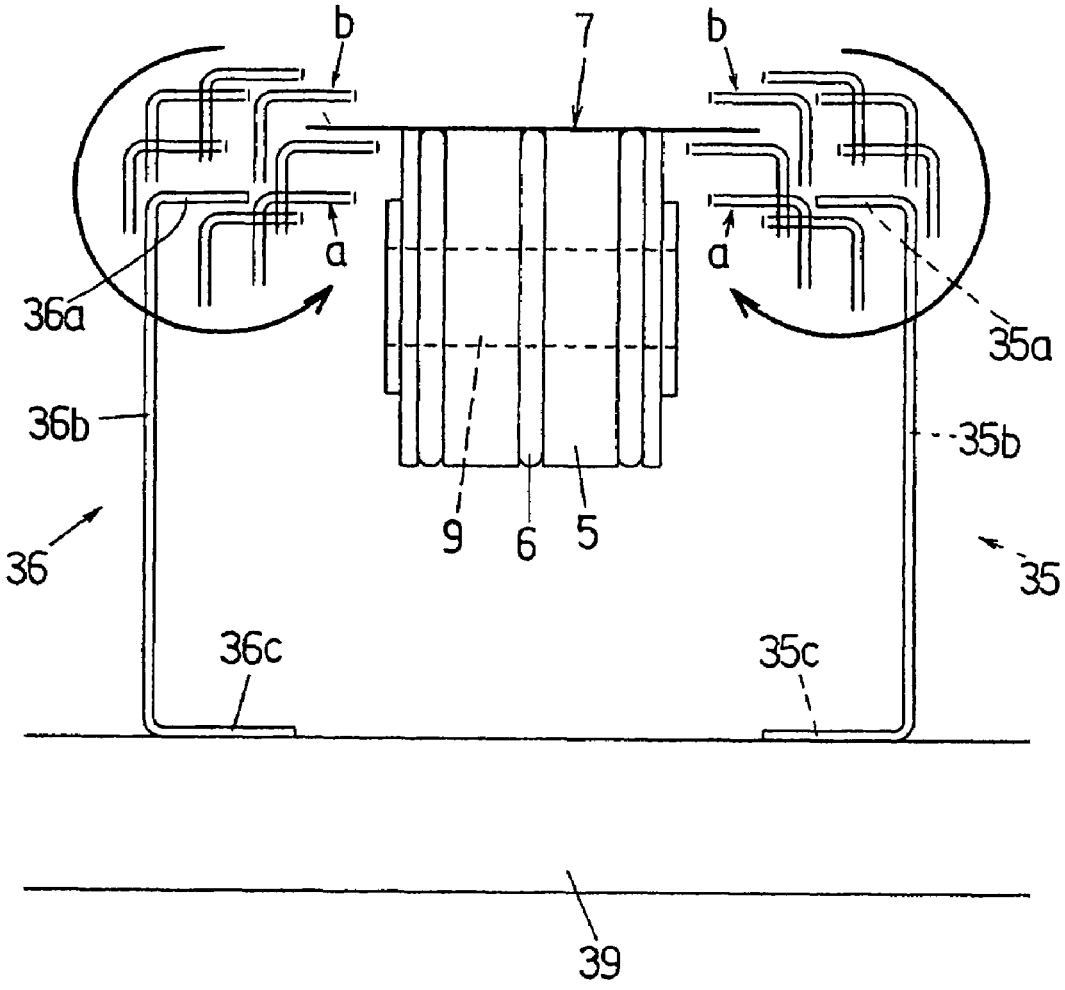
FIG. 4 is a front view of the essential components of the bag supporting portions, particularly showing the rotation track of the bag supporting portions.

The bag support members 35 and 36 are provided at a proximity of the rear edge of each belt conveyor 1, in other words, on the left and right sides of the pulley 5 in the shown structure (see FIG. 1). The bag support members 35 and 36 of the bag lifting device 2 are formed by bending a plate (made of metal, plastic, etc.), and, as best seen from FIG. 4, are respectively comprised of bag supporting portions 35*a* and 36*a*, upright portions 35*b* and 36*b*, and fixing portions 35*c* and 36*c*. The bag supporting portions 35*a* and 36*a* are formed at the upper end portions of the bag support members 35 and 36; and they are disposed on the left and right sides of the belt conveyor 1 and protrude horizontally in an inward direction. The center upright portions 35*b* and 36*b* of the bag support members 35 and 36 descend from the outside edges of the bag supporting portions 35*a* and 36*a*. The fixing portions 35*c* and 36*c* of the bag support members 35 and 36 are formed at the lower ends of the upright portions 35*b* and 36*b*.

The rotation mechanism 37 of bag lifting device 2 is comprised of two rotation transmission members 38 and 39 (see FIGS. 1 and 5), which are horizontal bars, and four crank mechanisms 41, 42, 43 and 44 (see FIG. 1), wherein two crank mechanisms 41 and 42 are connected to the two ends of the rotation transmission member 38, and two crank mechanisms 43 and 44 are respectively connected (linked) to two ends of the rotation transmission member 39. The rotation mechanism 37, as best seen from FIG. 1, further includes gears 45, 46, 47 and 48 that synchronously rotate the crank mechanisms 43 and 44 in one direction and the crank mechanisms 41 and 42 in another direction so that the rotation transmission members 38 and 39 rotate in the opposite directions. The rotation mechanism 37 further includes drive mechanisms 49 and 51 that respectively rotate the crank mechanisms 41 and 42. Crank shafts 41*a*, 42*a*, 43*a* and 44*a* of the respective crank mechanisms 41 to 44 are axially supported by axle sockets 52 disposed on the base platform 4. The drive mechanisms 49 and 51 respectively include a servo motor (not shown) and further, as best seen from FIG. 3, timing belts 53 and 54 and timing gears 55 and 56 driven by the servo motor.

Figure 5:
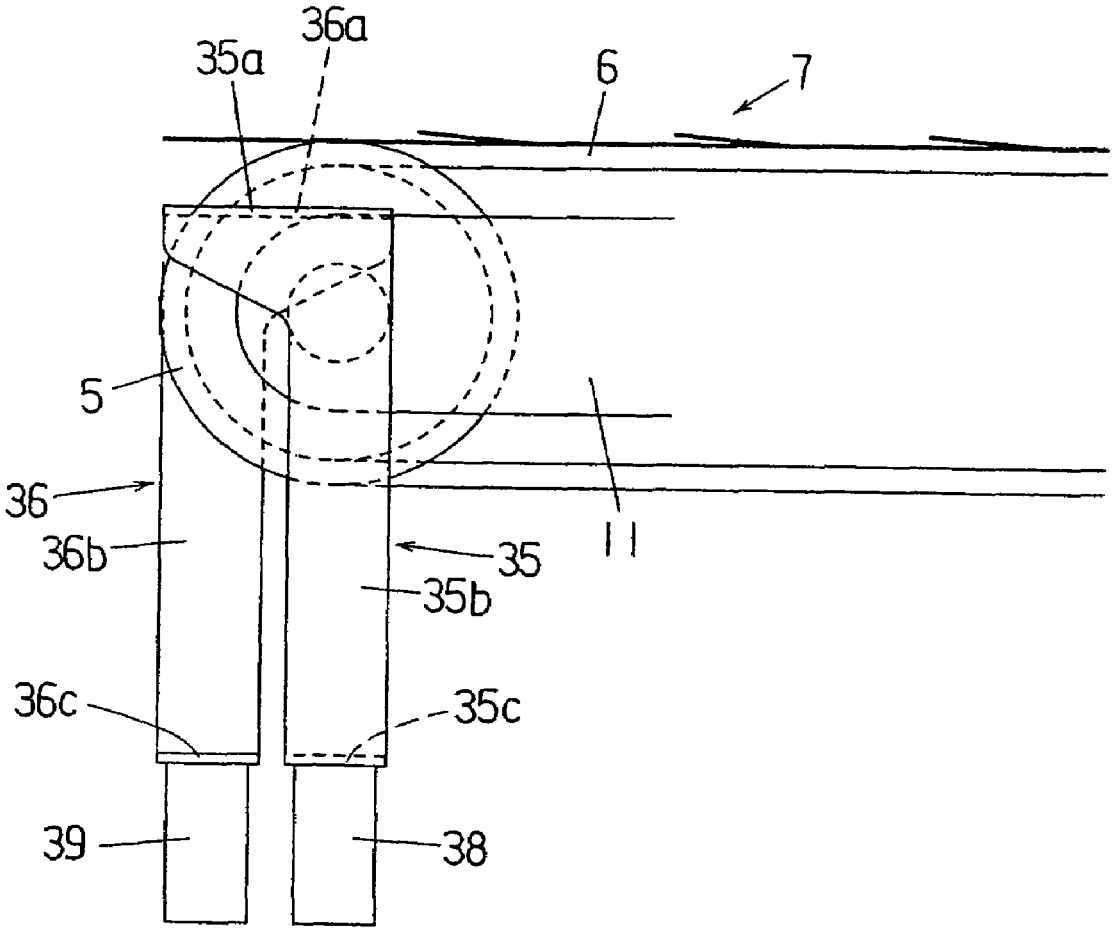
FIG. 5 is a right side view of the proximity of the bag supporting portions when the rotating bag supporting portions are at a position below the conveyance surface of the belt conveyor.

As seen from FIG. 5, the bag support members 35 (four of them) are provided on the rotation transmission member 38, and the bag support members 36 (four of them) are provided on the rotation transmission member 39.

As seen from FIG. 1, the crank shaft 41*a* of the crank mechanism 41, the crank shaft 42*a* of the crank mechanism 42, the crank shaft 43*a* of the crank mechanism 43, and the crank shaft 44*a* of the crank mechanism 44 are all provided parallel to the conveyance direction of and at the same height as the belt conveyors 1. Two ends of the rotation transmission member 38 are connected (linked) to the crank pins 41*b* and 42*b* of the crank mechanisms 41 and 42, and two ends of the rotation transmission member 39 are connected to the crank pins 43*b* and 44*b* of the crank mechanisms 43 and 44. The length (distance between the crank shaft and the crank pin) of the crank arms 41*c*, 42*c*, 43*c* and 44*c* of the respective crank mechanisms 41, 42, 43 and 44 is set to be the same for all of them. The crank arms 41*c* and 42*c* are mutually parallel, and the crank arms 43*c* and 44*c* are also mutually parallel. Consequently, the rotation transmission member 38 and the two crank arms 41*c* and 42*c*, and the rotation transmission member 39 and the two crank arms 43*c* and 44*c*, form a type of parallel link mechanism.

The rotational angle settings for the respective crank mechanisms 41-44 are rendered so that the orientation of the crank arms 41*c* and 42*c* (or the position of the crank pins 41*b* and 42*b* in relation to the crank shafts 41*a* and 42*a*) comes to a symmetrical position in relation to the orientation of the crank arms 43*c* and 44*c* (or the position of the crank pins 43*b* and 44*b* in relation to the crank shafts 43*a* and 44*a*).

In operation in the construction described above, when the crank shafts 41*a* and 42*a* are rotated rightward in FIG. 1 (rightward rotation when viewed from the rear) by the drive mechanisms 49 and 51, the rotation transmission member 38 imparts the translational motion of rightward rotation in a prescribed rotational radius on the vertical plane (FIG. 2, for instance) of the conveyance direction of the belt conveyor 1. On the other hand, when the rotational transmission member 38 is making the above described motions, the rotation transmission member 39 conversely imparts the translational motion of leftward rotation by the crank shafts 43*b* and 44*b* of the crank mechanisms 43 and 44 rotated leftward by being driven by the drive mechanisms 49 and 51 via the meshed gears 45 and 46 and meshed gears 47 and 48. The two rotation transmission members 38 and 39 thus make symmetric rotation.

The translational motion of rotation of each of the rotation transmission members 38 (that has the bag support members 35) and 39 (that has the bag support members 36) is transmitted to each of the bag supporting portions 35*a* and 36*a* via each bag support member 35 and 36, and, as shown in FIG. 4 by the curved arrows, the bag supporting portions 35*a* and 36*a* imparts translational motion on a vertical plane of the conveyance direction of the belt conveyor 1 in symmetrical and mutually opposing directions in the upper half of the rotation track.

More specifically, FIG. 4 shows the rotation track of the bag supporting portions 35*a* and 36*a* of bag support member 35 and 36.

The rotational center (which is just below the conveyance surface of the belt conveyor 1 and just outside both side edges of the bag bundle 7) and the rotational radius are set so that when the bag supporting portions 35*a* and 36*a* are being raised (or in the upward stroke), the bag supporting portions 35*a* and 36*a* move inwardly and come into contact from below with the two side edges of the bag bundle 7 (the side edges being the areas protruding from the belt conveyor 1 on the right and left sides), thus supporting the rear edge of the bag bundle 7 and then move outwardly and disengage from the two side edges of the bag bundle 7. This rotational track of the bag supporting portions 35*a* and 36*a* must be set so that the bag supporting portions 35*a* and 36*a* do not contact the conveyance element (the pulley 5 and the belt 6) of the belt conveyor 1 and that the gap between the upright portions 35*b* and 36*b* of the bag supporting portions 35 and 36 is not narrower than the width of the bags.

FIG. 5, a side view, shows the positional relationship between the bag supporting portions 35 and 36 and the bag bundle 7 when the bag supporting portions 35*a* and 36*a* reach the position indicated by a on the rotation track in FIG. 4. At this time, the bag supporting portions 35*a* and 36*a* have not yet lifted the bag bundle 7 above the conveyance surface of the belt conveyor 1.

Figure 6:
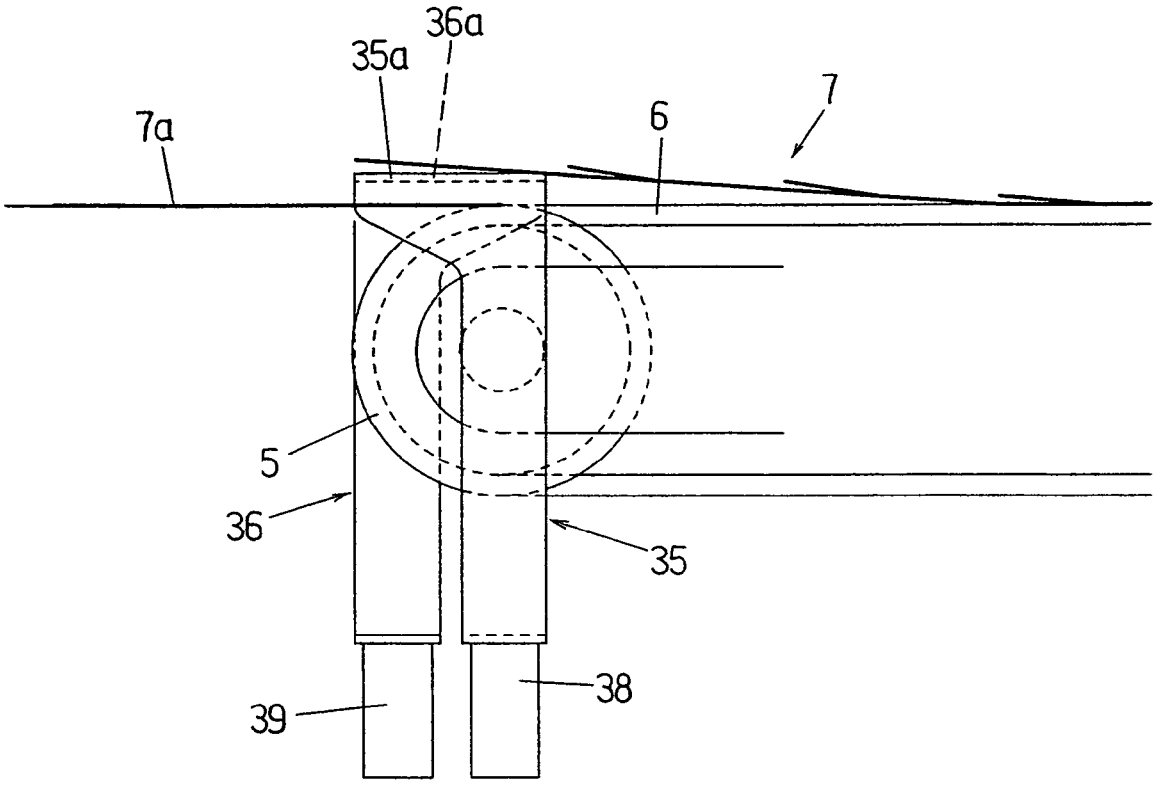
FIG. 6 is a side view of the proximity of the bag supporting portions when the rotating bag supporting portions are at a position above the conveyance surface.
Figure 7:
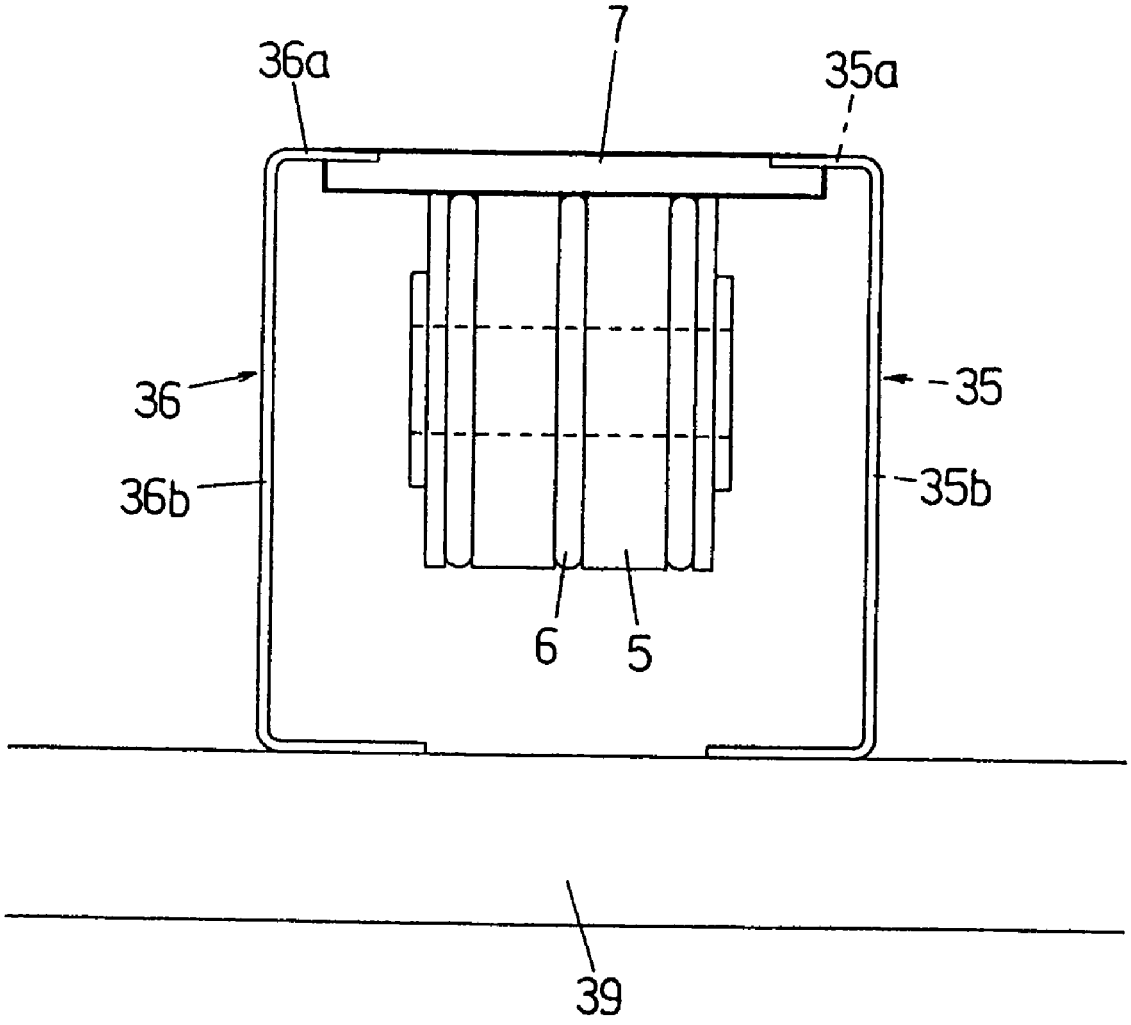
FIG. 7 is a font view (viewed from the left side of FIG. 6) of the proximity of the bag supporting portions when the bag supporting portions are at a position above the conveyance surface of the belt conveyor.

FIGS. 6 and 7, side views as well, show the positional relationship between the bag supporting portions 35 and 36 and the bag bundle 7 when the bag supporting portions 35*a* and 36*a* reach the position indicated by b on the rotation track in FIG. 4. At this time, the bag supporting portions 35*a* and 36*a* have lifted the bag bundle 7 to a prescribed height, creating a gap between the bag bundle 7 and the conveyance surface of the belt conveyor 1.

In FIG. 6, the bag 7*a* on the rear side (left side) is a new bag which is being fed from the bag feeding device 3 (see FIG. 1), and this bag is fed to the tail end of the bag bundle 7 on the conveyance surface of the belt conveyor 1 through the gap between the bag bundle 7 and the conveyance surface of the belt conveyor 1.

The thickness of the bag supporting portions 35*a* and 36*a* that are for supporting the bag bundle 7 needs to be considered in relation to the gap described above. However, since only a single bag is fed, and since the thickness of the bag supporting portions 35*a* and 36*a* can be reduced, the thickness of the bag supporting portions 35*a* and 36*a* does cause any significant problem.

Overall operational timing in the bag supply apparatus according to the present invention is, for example, as follows:

(1) In the bag feeding device 3, the bag transfer member 32 (see FIGS. 1 and 2) for each one of four belt conveyors 1 uses the adsorption member 34 to suction-hold a bag 7*a* and pivot to a horizontal position, so that the bag 7*a* is placed on the bag supporting platform 18.

Then, the air cylinder 24 is activated to raise the feed pins 15 so that the pins protrude upward from the conveyance surface of the bag supporting platform 18. Needless to say, the position at which the feed pins 15 protrude is behind the bag 7*a* placed on the bag supporting platform 18.

Next, the drive power source (not shown) advances the slide member 27 forward (or upward in FIG. 1 and to the right in FIG. 2) so that the feed pins 15 make contact with the rear edge of the bag 7*a* on the bag supporting platform 18, and the bag 7*a* is pushed forward toward the belt conveyor 1.

The bag transfer member 32 then returns to a vertical position and suction-holds the next bag.

(2) In the bag lifting device 2, the servo motor (not shown) is being activated so that the bag supporting portions 35*a* and 36*a* are continuously making translational motion of rotation. With the same timing as when the feed pins 15 push the bag 7*a* forward into the bag feeding device 3, the bag supporting portions 35*a* and 36*a* make contact with and raise the rear edge of the bag bundle 7 mounted on the conveyance surface of the belt conveyor 1, forming a gap between the conveyance surface and the bag bundle 7. The bag 7*a* that was pushed forward by the feed pins 15 is fed into the gap and to a prescribed position (a position separated to the rear by a constant pitch from the bag at the very end to that point) on the conveyance surface of the belt conveyor 1.

(3) The belt conveyor 1 stops when the bag supporting portions 35*a* and 36*a* make contact with the rear edge of the bag bundle 7 mounted on the conveyance surface of the belt conveyor 1 and lift up the bag bundle 7. The feed pins 15 feed the bag 7*a* in the interval during which the belt conveyor 1 is stopped.

After the new bag 7*a* is supplied, the belt conveyor 1 is intermittently operated for one pitch, and the feed pins 15 that fed the bag 7*a* immediately are moved down and then moved rearward.

The above operation is made with reference to all of the four belt conveyors 1 simultaneously; however, such can be made for selected one or plurality of conveyers as well.

The foregoing example represents one embodiment of the present invention, and a variety of alterations are possible. For example, a conveyance means (conveyer) can be used instead of the belt conveyor 1, the belt conveyor 1 can be continuously operated, and the bag supporting portions 35*a* and 36*a* of the bag supporting portions 35 and 36 can be of a rod-shaped instead of plates. Furthermore, it is possible to alter the rotation speed of the bag supporting portions 35*a* and 36*a* while it is in operation, and the bag supporting portions 35*a* and 36*a* can be rotated intermittently. In addition, the bag feeding device 3 can be substituted by another feeding means such as a belt conveyor, and the bag feeding device 3 can feed a bag bundle instead of single bags.

The invention claimed is:

1. A bag supply apparatus for supplying bags onto a conveyer for transporting a bag bundle stacked in such a format that an upper level bag is shifted forward, comprising a bag lifting device for lifting a rear edge of the bag bundle which is on the conveyer; and a bag feeding device, provided at a rear of the conveyer, for transporting a new bag forward, when the rear edge of the bag bundle on the conveyer is lifted, and feeding the bag between the bag bundle lifted above the conveyer and a conveyance surface of the conveyer;

wherein said bag lifting device is comprised of:

a pair of bag support members disposed opposite one another on either side of the conveyer and having bag supporting portions protruding inwardly and horizontally; and a rotation mechanism for imparting translational motion of rotation to the bag support members, the translational motion being symmetrical on a plane that is perpendicular to a conveyance direction of the conveyer and being in mutually diverging directions in an upper half of a rotation track of the bag support members; and wherein the rotational center and the rotational radius of the bag support members relative to both side edges of the bag bundle are configured such that the bag supporting portions of bag support members, when the bag support members are moving upward, are brought into contact from below with both side edges of the bag bundle and lift the rear edge of the bag bundle, and then the bag supporting portions are separated outwardly from both side edges of the bag bundle, wherein the bag lifting device includes, as a part of the rotation mechanism, a pair of rotation transmission members that make a translational motion of the same rotational radius and rotational direction as each one of the bag support members on a plane perpendicular to the conveyance direction, wherein the bag support members are respectively provided on the rotation transmission members wherein the rotation mechanism of the bag lifting device is comprised of:

four crank mechanisms in which two of the crank mechanisms are linked to each one of the rotation transmission members, and a drive power source for operating the crank mechanisms; and wherein in said two crank mechanisms linked to each rotation transmission member:

crank shafts thereof are disposed at a same height and with a distance in between in a horizontal direction, provided in parallel in the conveyance direction of the conveyer, and rotated synchronously in a same direction, crank arms thereof have a same length and are provided so as to be mutually parallel, and one of the rotation transmission members is linked to each crank pin thereof.

2. The bag supply apparatus according to claim 1, wherein a rotational speed of the bag lifting device in an angular range, in which the pair of bag supporting portions are lifting the rear edge of the bag bundle above the conveyance surface, is slower on average than a rotational speed in a remaining angular range.

3. The bag supply apparatus according to claim 1, wherein said conveyer is provided in a plurality of numbers in parallel, said pair of bag support members are provided for each one of the conveyers, and said bag feeding device is provided at the rear of each one of the conveyers; and wherein the rotation transmission members are provided in a pair, and a plurality of said bag support members are provided on each one of the rotation transmission members and make a translational motion synchronously.

4. The bag supply apparatus according to any one of claims 1, or 3, wherein the bag feeding device is provided with:

a bag supporting platform with an upper surface thereof being a conveyance surface; and feed pins protruding upward from the conveyance surface of the bag supporting platform and making contact with the rear edge of the bag on the conveyance surface of the bag supporting platform and transporting the bag forward.

5. The bag supply apparatus according to claim 4, wherein the new bag fed by the bag feeding device is a bag bundle formed by a stack of a plurality of bags.

6. The bag supply apparatus according to any one of claims 1, or 3, wherein the new bag fed by the bag feeding device is a bag bundle formed by a stack of a plurality of bags.

7. The bag supply apparatus according to claim 1, wherein the new bag fed by the bag feeding device is a bag bundle formed by a stack of a plurality of bags.

* * * * *